US006551013B1

(12) United States Patent
Blair

(10) Patent No.: US 6,551,013 B1
(45) Date of Patent: Apr. 22, 2003

(54) SPIKE BELT

(75) Inventor: William L. Blair, Wheeling, WV (US)

(73) Assignee: PMG, Inc., Wheeling, WV (US)

( * ) Notice: Subject to any disclaimer, the term of this patent is extended or adjusted under 35 U.S.C. 154(b) by 0 days.

(21) Appl. No.: 09/990,525

(22) Filed: Nov. 21, 2001

Related U.S. Application Data

(60) Provisional application No. 60/252,554, filed on Nov. 22, 2000.

(51) Int. Cl.[7] ..... E01F 13/12
(52) U.S. Cl. ..... 404/6
(58) Field of Search ..... 404/6, 9; 256/13.1, 256/1

(56) References Cited

U.S. PATENT DOCUMENTS 3,652,059 A * 3/1972 Groblebe ..... 256/1
4,097,170 A * 6/1978 Dickinson ..... 404/11
4,231,125 A * 11/1980 Tittl ..... 5/419
5,890,832 A * 4/1999 Soleau ..... 256/1
6,048,128 A * 4/2000 Jones et al. ..... 256/13.1
6,224,291 B1 * 5/2001 Mateychuk ..... 404/6
6,322,285 B1 * 11/2001 Ben ..... 404/6
6,357,961 B1 * 3/2002 Marphetia ..... 404/6
6,409,418 B1 * 6/2002 Blair et al. ..... 404/6
6,409,420 B1 * 6/2002 Horton et al. ..... 404/6

FOREIGN PATENT DOCUMENTS

FR 2605655 * 4/1988 ..... E01F/9/14

* cited by examiner

*Primary Examiner*—Thomas B. Will
*Assistant Examiner*—Alexandra K. Pechhold

(57) ABSTRACT

A portable tire deflation device designed for a law enforcement officer to deploy across a lane of traffic. The device is a band of spring steel being about 10–12 feet in length and about 5–8 inches in width, divided into multiple segments wherein each segment has a strip of hollow steel spikes that are removably secured in the strip. Furthermore, each strip of spikes is offset from the strips in the other segments of the band. At least one or more of the segments also has an elongated aperture that is aligned with a strip of spikes in an adjacent segment. To store the device, a user simply starts at one end and rolls up the band. A hook and loop fastener, e.g., VELCRO®, strip is used to secure the device in the rolled up position. Due to the fact that the strips of spikes in each segment of the band are offset, the spikes can be easily rolled up. That is, a strip of spikes of a first segment is aligned with an elongated aperture of a second segment such that the spikes protrude through the aperture during storage.

20 Claims, 4 Drawing Sheets

SPIKE BELT

CROSS-REFERENCE TO RELATED APPLICATIONS

This application claims the benefit of U.S. Application No. 60/252,554, filed Nov. 22, 2000.

BACKGROUND OF THE INVENTION

1. Field of the Invention

This invention relates to tire deflating devices, and more particularly, to a band having strips of spikes and corresponding elongated apertures that allow the band to be rolled up.

2. Related Art

Law enforcement personnel, as well as other tactical security personnel. are often called to either halt a fleeing vehicle, or to disable a vehicle that has trespassed into a secure area. It is desirable in these circumstances to slow the vehicle by partially, or completely. disabling the vehicle. One popular method of disabling a vehicle is by deflating its tires. Those skilled in the art appreciate that firing weapons at a fleeing vehicle's tires is inefficient, often ineffective and presents an unacceptable risk of injury to law enforcement/security personnel or bystanders. Accordingly, a number of devices have been developed to serve as partial or complete barricades or that can be deployed across a roadways for the purpose of puncturing a vehicle's pneumatic tires as the vehicle passes over the device.

In this regard, U.S. Pat. No. 5,775,832, issued to Kilgrow, et al., on Jul. 7, 1998, discloses a compact tire deflator having pivotally connected opposing panels and one or more hollow spikes. U.S. Pat. No. 5,820,293, issued to Groen et al., on Oct. 13, 1998, discloses a vehicle tire deflation device comprising a base and a plurality of hollow tire deflating quills secured to the base. The base is configured so as to provide a tire penetrating orientation and a non-tire penetrating orientation. U.S. Pat. No. 5,839,849, issued to Pacholok et al., on Nov. 24, 1998, discloses a mechanical tire deflating device that deploys a folded deflating spike under a vehicle desired to be stopped. The spikes are extended when the mechanical device is under the vehicle to be stopped. U.S. Pat. No. 5,611,408, issued to Abukhader, on Mar. 18, 1997, discloses a vehicle disabling device that is propelled by a chase vehicle and deploys beneath a vehicle to be stopped. When deployed, the device extends a plurality of spikes that destroy and deflate the fleeing vehicle's tires. U.S. Pat. No. 5,536,109, issued to Lowndes, on Jul. 16, 1996, discloses a road vehicle halting device comprising a support member, a plurality of support elements and means for mounting the support elements on the support member in which each of the supporting elements supports a generally upwardly extending spike. The Lowndes device is configured in a "lazy tong" configuration and teaches that the spikes are pulled from the spike cups as the vehicle rolls over the device.

Also, U.S. Pat. No. 4,995,756, issued to Kilgrow et al., on Feb. 26, 1991, discloses a vehicle tire deflator having a pivoting tong configuration which utilizes a series of rocker arms and actuators to cant the spikes toward the tire upon impact. Kilgrow et al. teach that the spike is pulled from the socket as the tire rolls over the device. U.S. Pat. No. 5,253,950, issued to Kilgrow et al., on Oct. 19, 1993, (and reissue U.S. Pat. No. Re. 35,373 issued on Nov. 5, 1996) discloses an improvement over the device disclosed in Kilgrow et al. '756. U.S. Pat. No. 4,382,714, issued to Hutchison, on May 10, 1983, discloses a vehicle disabling means in the form of a plurality of spike like devices adapted to project perpendicular to a road surface to puncture one or more of a vehicle's tires. U.S. Pat. No. 3,652,059, issued to Groblebe, on Mar. 28, 1972, discloses a tire puncturing device to impede movement of a vehicle which utilizes a plurality of hollow, sharpened nail-like members releasably secured in spaced relation along the length and width of an elongated strip spread across the width of a roadway. U.S. Pat. No. 5,482,397, issued to Soleau, on Jan. 9, 1996, discloses a tire deflator which utilizes a spike and its associate support block being supported by a support mechanism adapted such that the spike and support block separate from the support mechanism as the tire rolls over the support mechanism.

While it is presumed that the aforementioned devices will effectively deflate the tires of a fleeing vehicle, there are several disadvantages to using these devices. For example, most tire deflation devices currently in use are bulky in dimensional size and may comprise numerous moving parts, whereby becoming inherently cumbersome in view of portability, storage, operation, and maintenance. In particular, prior art tire deflation devices commonly consist of one or more collapsible frames having numerous structural features engageably disposed in relation therewith and are usually constructed in such a manner so as to provide an extendible means tor covering the width of a lane of traffic or an entire roadway by using a single device or, in the alternative, by disposing a plurality of extendable frames in a connectable relationship across a roadway.

Consistent with the foregoing, the operational deployment of prior art tire deflation devices is usually awkward in regards to handling and often difficult to quickly or surreptitiously move as a result of their inherently large size and considerable weight. Consequently, law enforcement officers without a car will generally not have ready access to prior art tire deflation devices. Even those officers with a motorized vehicle having sufficient space for storing a prior art tire deflation device will typically need to have their vehicle near the desired deployment area in order to deploy the deflation device. In short, because prior art tire deflation devices generally require a considerable amount of surface area for storage, many law enforcement officers may not have ready access to these deflation devices when a situation arises for restricting the passage or movement of a vehicle.

Another significant disadvantage of prior art tire deflation devices is the intrinsic risk of sustaining serious personal injuries in association with contacting the sharp protruding ends of one or more spikes if these devices are not handled carefully. To alleviate the inherent risk of injuries, custom-built housing assemblies were developed by those skilled in the art to provide a means for protecting a user from exposed spike tips. However. such protective measures typically consume additional storage space and are customarily more costly in relation to manufacturing costs.

Consistent with the foregoing, while the prior art tire deflation devices disclosed above appear generally suitable for their intended purposes, these tire deflation devices nevertheless leave much to be desired from the standpoint of transportability, simplicity of construction, safety in operation, and required maintenance. As will be appreciated in the art, economic considerations are significant when dealing with the highly competitive law enforcement industry, since relatively complicated devices are frequently found to be commercially impractical. Accordingly, even a slight savings in the cost may substantially enhance the commercial appeal of a particular component or assembly when considering issues of mass production.

SUMMARY OF THE INVENTION

The present invention solves the problems encountered with complex, mechanically deployed tire deflating devices by providing a virtually self-deploying device that is activated by simply releasing the energy stored in a steel spring band. The present invention further solves the problems encountered with previously introduced "simple" devices by providing a tire deflating device that can be easily stored and transported due to the presence of elongated apertures that correspond to the strips of spikes thereby allowing the device to be rolled up while retaining the spikes.

An aspect of the invention is a portable tire deflating device, including a band having a first end, a second end, a length, a top surface, a bottom surface and one or more elongated apertures positioned along the length of the band; one or more spikes; and one or more strips of spikes positioned along the length of the band such that when the first end of the band is rolled toward the second end, each of the one or more strips of spikes aligns with one of the elongated apertures such that the spikes protrude through the apertures.

A feature of the invention is a spring steel band that has sufficient potential energy when rolled into the stored position, that upon release of the storing and securing means, the spring steel un-rolls and practically deploys itself across a roadway or surface to be blocked.

Another feature of the invention is one or more hollow spikes that rapidly and safely deflate vehicles tires by transferring air from the tire through the length of the hollow spike.

Another feature of the invention is one or more strips that allow the spikes to be easily attached to the band.

Another feature of the invention is one or more elongated apertures strategically aligned with the strips of spikes such that when the band is rolled up, the strips align with the apertures thereby allowing the spikes to protrude through the elongated apertures.

An advantage of the invention is that the tire deflating device is easily deployed and simply requires the user to release the stored energy for the device to be deployed across a lane of traffic.

Another advantage is that the tire deflation device is reusable in that the band is not damaged or destroyed with normal use. A user can simply replace the spikes after use with new spikes and then reattach them to a strip of the device for the next time it is needed.

Another advantage is that when a vehicle rolls over a tire deflation device of the present invention, the hollow spikes become embedded in the tire and the air of the tire then escapes through the hollow spikes, thereby rendering the tire worthless and the vehicle unable to be driven.

Another advantage of the invention is that the device provides an efficient and cost effective means for deflating vehicle tires and rendering a vehicle useless because the device relies on potential energy stored in the band instead of a complex mechanical structure to deploy the device.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawings in which the reference number first appears.

DETAILED DESCRIPTION OF THE PREFERRED EMBODIMENTS

Figure 1:
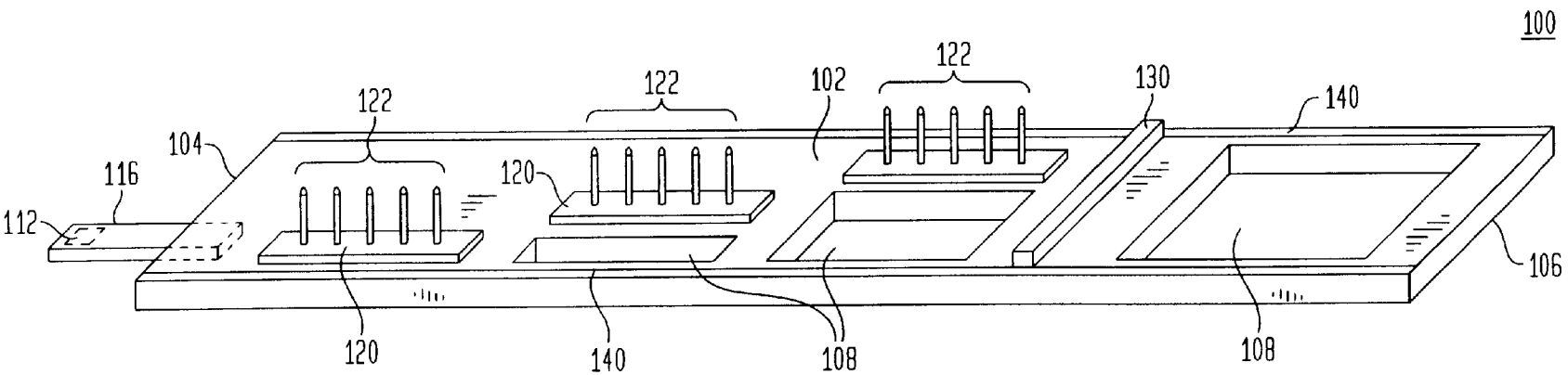
FIG. 1 shows a portable tire deflating device of the present invention in a deployed state.
Figure 2:
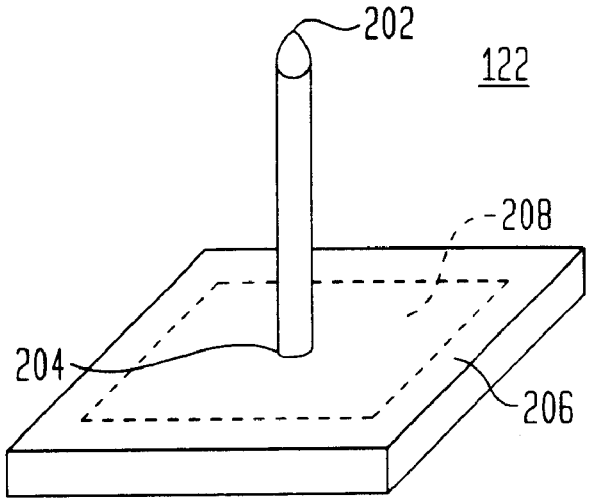
FIG. 2 shows an embodiment of a spike.
Figure 3:
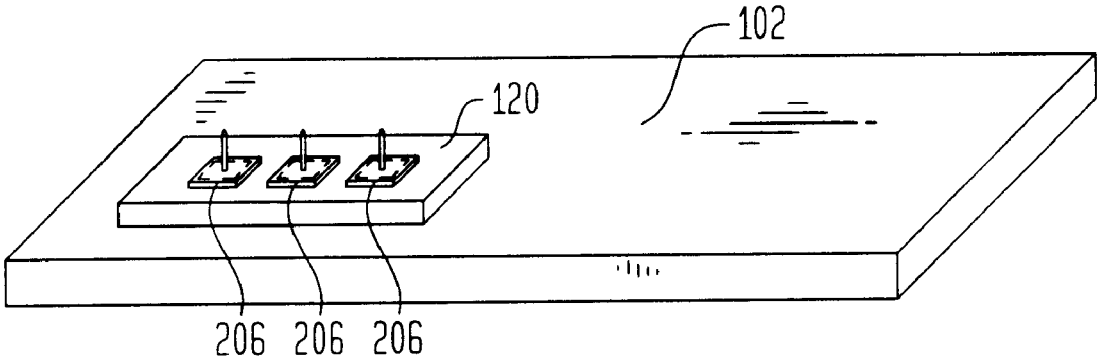
FIG. 3 shows a strip of spikes connected to a band.
Figure 4:
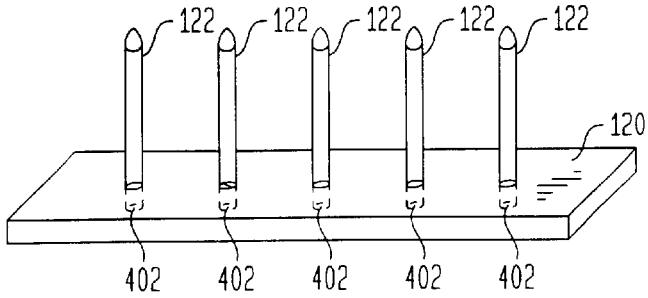
FIG. 4 shows an alternative embodiment of spikes mounted to a strip.

An embodiment of the portable tire deflating device 100 of the present invention is shown in FIG. 1. The portable tire deflating device 100 includes a band 102 that can be rolled up for storage and un-rolled for deployment. The band 102 is preferably a spring steel band that stores a sufficient amount of potential energy that upon release of a storing and/or a securing mechanism, the band un-rolls itself thereby deploying the portable tire deflating device 100 across a roadway. The band 102 is preferably about 8 to about 15 feet long, with a most preferred length of about 10 to about 12 feet. The preferred width is about 3 to about 10 inches, with a most preferred width of about 5 to about 8 inches. Also, the band is preferably made from a conventional gauge stainless steel about 0.015 to about 0.25 of an inch thick, with the most preferred thickness being about 0.018 of an inch.

In a preferred embodiment, the band 102 has one or more strips 120 of spikes 122 positioned along its length in order to deflate the tire(s) of an oncoming vehicle when the portable tire deflating device 100 is deployed. The number of spikes 122 per strip 120 may be varied, but is preferably between about 5 and about 10 spikes 122. The strips 120 are preferably staggered, or offset from each other, along the length of the band 102, thereby allowing the band 102 to be rolled up for storage with the strips 120 and spikes 122 in place. The strip(s) 120 are preferably glued and riveted to the band 102 according to conventional means, but may be attached by alternative means known to one of ordinary skill in the art.

In one embodiment of the invention, a strip 120 is an elongated strip of a hook and loop fastener, e.g., a heavy-duty VELCRO®. Each spike 122 is a hollow roll pin wherein one end, the pointed end 202, is sharpened to a point and the other end, the base end 204, is secured to a support base 206. The support base 206 is also preferably made of metal and may be any shape. The preferred support base 206 is square and is about ⅛ of an inch thick. The bottom side of the support base 206 has a matching hook and loop fastener, e.g., VELCRO® 208, such that the spike 122 is removably attached to the strip 120 by the hook and loop fastener, e.g., VELCRO®, of the strip 120 and the hook and loop fastener, e.g., VEILCRO® 208, on the bottom of the support base 206.

Figure 5:
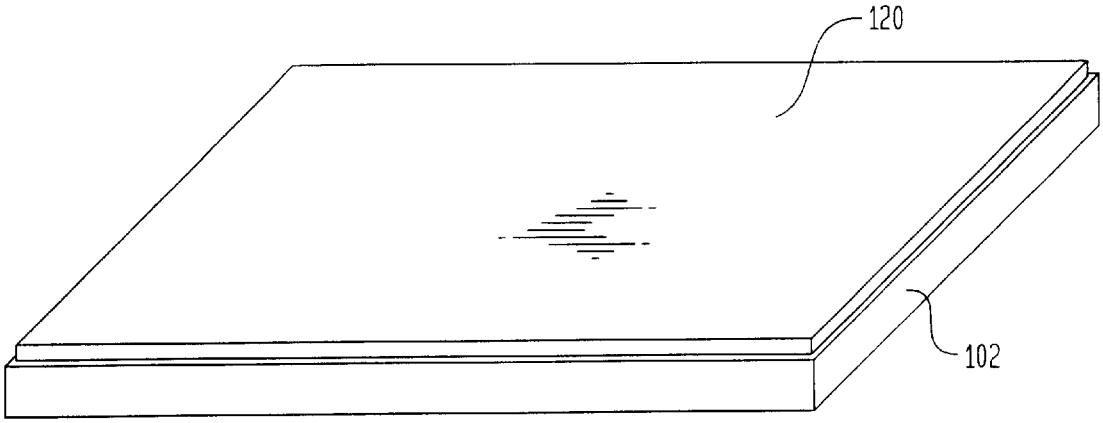
FIG. 5 shows an alternative embodiment of a strip.
Figure 6:
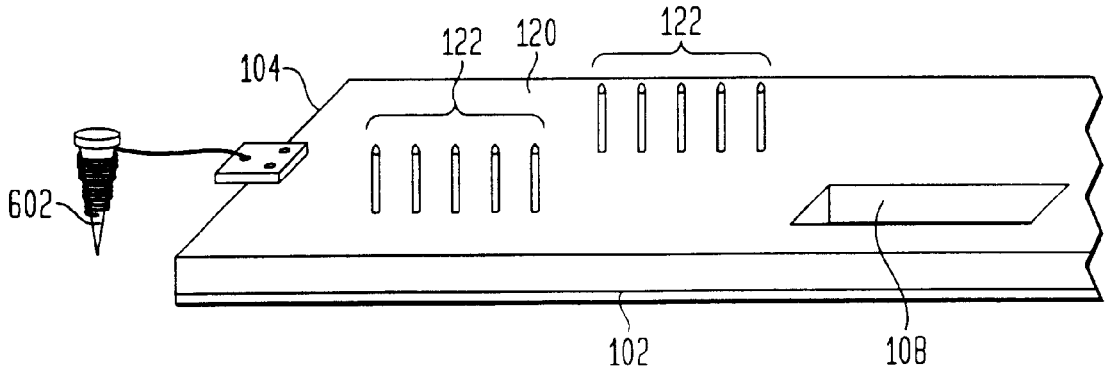
FIG. 6 shows an embodiment of a handle.
Figure 7:
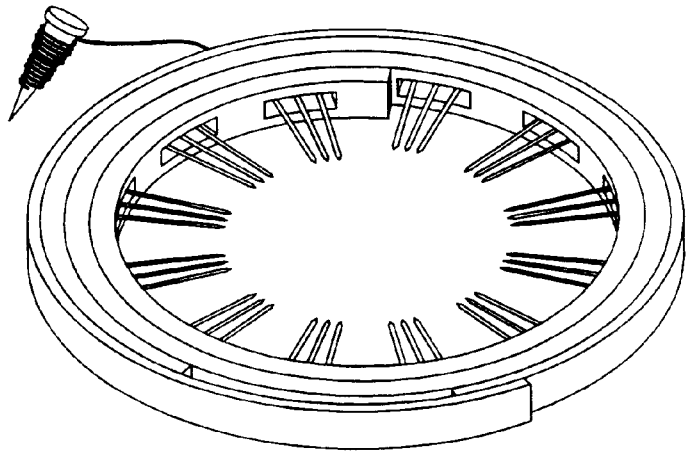
FIG. 7 shows the portable tire deflating device rolled up for storage.

In an alternative embodiment, the strip(s) 120 are made of an elastic material, such as, but not limited to natural rubber, neoprene, buna rubbers. butyl rubber, or Thiokol, with the preferred elastic material being neoprene. Preferably each strip 120 of neoprene is about ½ inch wide and about ½ inch thick. Alternatively, as shown in FIG. 5, the strip 120 may be about the same size as the band 102 such that the strip 120 covers the entire top surface of the band 102.

A spike 122 is held within a hole 402 in the strip 120 by the inherent features of the neopreme rubber; that is, the elasticity of the rubber closes in and holds the spike 120 upright. As a result, a spike 120 may be used that is hollow along its entire longitudinal axis thereby causing air to escape from a punctured tire more rapidly. The spikes 122 are preferably inserted into the strip(s) 120 by first drilling small holes 402 in the strip(s) 120 and then inserting the spikes 122. The diameter of the holes 402 must be equal to, or slightly smaller than, the diameter of the spikes 122.

Alternatively, spikes 122 with two pointed ends may be inserted into the strip(s) 120 merely by pounding the spikes 122 into the strips 120.

Also in the preferred embodiment, one or more cross bars 130 are used to assist in holding the band 102 of a deployed tire deflation device 100 flat on a road surface. A cross bar 130 is preferably a piece of metal that is secured between two adjacent strips 120 of spikes 122 positioned along the length of the band 102. A cross bar 130 may be positioned between any two adjacent strips 120 of spikes 122, however, for optimum performance, a cross bar 130 is positioned approximately every 3 to 5 feet along the length of the band 102. This spacing of cross bar(s) 130 ensures that the band 102 will lie flat and be stable on the road surface as cars pass over top of the device 100.

The band 102 also has one or more elongated apertures 108 along its length that allow the spikes 122 to protrude therethrough when the band 102 is rolled up for storage. Specifically, the elongated apertures 108 and strips 120 of spikes 122 are positioned along the length of the band 102 such that when the first end 104 of the band 102 is rolled toward the second end 106, each strip 120 of spikes 122 aligns with a specific elongated aperture 108 thereby allowing the spikes 122 to protrude through the elongated apertures 108. As a result, the portable tire deflating device 100 can be rolled up for storage without taking the spikes 122 out of the band 102.

The portable tire deflating device 100 is preferably held in a rolled up position by a means for storing the device 100. The preferred means for storing is a strap 116 attached to the first end 104 of the band 102. The strap 116 includes a means for securing the strap 116, which is preferably a hook and loop fastener, e.g., VELCRO®, strip 112. The strap 116 is preferably long enough that the strap 116 extends around the outside of the rolled up device 100 and the hook and loop fastener, e.g., VELCRO®, strip 112 secures the end of the strap 116 to the remaining body of the strap 116 near the first end 104 of the device 100. Alternatively, the means for storing may include snaps, buckles, loops, strings, or other means known to one of ordinary skill in the art. For long-term storage and/or transporting of the portable tire deflating device 100, the rolled device 100 can be placed in a storage container, such as a canister or bag.

Also in the preferred embodiment, a handle 602 may be attached to the first end 104 of the band 102 for providing a user the means for facilitating the deployment and retraction of the device 100 on a roadway. For example, the handle 602 may comprise a spool of string on a spool handle, a tether, or pole, which is grabbed by the user. The user may use the handle 602 to move and position the device 100 on the roadway, as well as. to pull the device 100 off the roadway when its use is no longer required.

The rate at which the portable tire deflating device 100 is un-rolled (or deployed) is controlled by the physical characteristics of the band 102, i.e., the amount of potential energy stored in the rolled band, as well as by a hook and loop fastener, e.g., VELCRO®, strips 140 placed lengthwise along the edges of the top and bottom surfaces of the band 102. For example, as the first end 104 of the device 100 is rolled toward the second end 106, the dense layer of loops forming the hook and loop fastener, e.g., VELCRO®, strips 140 on the bottom surface of the band 102 comes into contact with the dense layer of hooks forming the hook and loop fastener, e.g., VELCRO®, strips 140 on the top surface of the band 102. Because these hook and loop fastener, e.g., VELCRO®, strips 140 have an affinity for each other, they will slow/control the rate at which the band un-rolls, thereby controlling the rate at which the device 100 is deployed.

Conclusion

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus., the breadth and scope of the present invention should not be limited by any of the above-described exemplary embodiments, but should be defined in accordance with the specification and any equivalents.

What is claimed is:

1. A portable tire deflating device, comprising:

a band having a first end, a second end, a length, a width, a top surface, and a bottom surface;

a plurality of spikes;

two or more strips, each of said strips having a plurality of said spikes, said strips positioned sequentially along the length of said band while being staggered across the width of said band, such that each of said strips is in a separate longitudinal axis parallel to the length of said band and in a separate traverse axis parallel to the width of said band; and two or more elongated apertures positioned sequentially along the length of said band, each of said elongated apertures aligned along the longitudinal axis of one or more said strips and being in a separate traverse axis parallel to the width of said band.

2. The portable tire deflating device according to claim 1, further comprising a means for storing the portable tire deflating device.

3. The portable tire deflating device according to claim 2, wherein said means for storing the portable tire deflating device is selected from the group consisting of a strap connected to the first end of said band and a means for securing said strap, a canister, and a bag.

4. The portable tire deflating device according to claim 3, wherein said means for securing said strap is a hook and loop fastener.

5. The portable tire deflating device according to claim 1, wherein each said spike has a point end and a base end, said base end being attached to a support base.

6. The portable tire deflating device according to claim 5, wherein said support bases of said spikes are removably attached to said two or more strips.

7. The portable tire deflating device according to claim 1, wherein said two or more strips are made of an elastic material for holding said spikes in an upright position.

8. The portable tire deflating device according to claim 7, further comprising one or more cross bars for assisting in holding said band of a deployed tire deflating device flat on a road surface.

9. The portable tire deflating device according to claim 8, wherein said one or more cross bars are pieces of metal secured to said band by rivets, nails, or screws.

10. The portable tire deflating device according to claim 7, wherein said elastic material is selected from the group consisting of natural rubber, neoprene, buna rubbers, butyl rubber, and Thiokol.

11. The portable tire deflating device according to claim 7, wherein each of said strips is glued to said band.

12. The portable tire deflating device according to claim 7, wherein each of said strips is riveted to said band.

13. The portable tire deflating device according to claim 1, further comprising a handle attached to the first end of the band.

14. The portable tire deflating device according to claim 13, wherein said handle is selected from the group consisting of a spool of string and a spool handle, a tether, and a pole.

15. The portable tire deflating device according to claim 1, wherein said band is spring steel.

16. The portable tire deflating device according to claim 1, wherein said band further comprises one or more hook and loop fastener strips positioned along the length of the top surface and bottom surface of said band, such that a hook and loop fastener strip positioned on the bottom surface of said band contacts a hook and loop fastener strip positioned on the top surface of said band when the first end of said band is rolled toward the second end.

17. A method for deflating one or more tires of a vehicle, comprising the steps of:

(a) deploying a portable tire deflation device comprising a band having a first end, a second end, a length, a width, a top surface, and a bottom surface;

a plurality of spikes;

two or more strips, each of said strips having a plurality of said spikes, said strips positioned sequentially along the length of said band while being staggered across the width of said band, such that each of said strips is in a separate longitudinal axis parallel to the length of said band and in a separate traverse axis parallel to the width of said band; and two or more elongated apertures positioned sequentially along the length of said band, each of said elongated apertures aligned along the longitudinal axis of one or more said strips and being in a separate traverse axis parallel to the width of said band; and (b) positioning said portable tire deflation device across a roadway.

18. The method according to claim 17, further comprising the steps of:

(c) retracting said portable tire deflation device by rolling the first end of said band toward the second end of said band wherein each of said strips of said spikes aligns with one of said elongated apertures such that said spikes of said strips protrude through one of said elongated apertures, resulting in said portable tire deflation device being in a rolled position and said spikes point inward toward a center of said rolled position; and (d) securing said band in said rolled position.

19. A stored portable tire deflating device, comprising:

a band having a first end, a second end, a length, a width, a top surface, and a bottom surface;

a plurality of spikes;

one or more strips, each of said strips having a plurality of said spikes, said strips positioned sequentially along the length of said band while being staggered across the width of said band, such that each of said strips is in a separate longitudinal axis parallel to the length of said band and in a separate traverse axis parallel to the width of said band; and one or more elongated apertures positioned sequentially along the length of said band, each of said elongated apertures aligned along the longitudinal axis of one or more said strips and being in a separate traverse axis parallel to the width of said band;

wherein the first end of said band is rolled toward the second end, resulting in the stored portable tire deflation device being in a rolled position and each of said one or more strips aligns with one of said one or more elongated apertures and said spikes of each of said strips protrude through one of said elongated apertures such that said spikes point inward toward a center of said rolled position.

20. The stored portable tire deflating device according to claim 19, further comprising a means for storing the stored portable tire deflating device, wherein said means for storing is selected from the group consisting of a strap connected to the first end of said band and a means for securing said strap, a canister, and a bag.

* * * * *